US007225499B1

(12) United States Patent
Duncan et al.

(10) Patent No.: US 7,225,499 B1
(45) Date of Patent: Jun. 5, 2007

(54) MOP PRESS

(75) Inventors: Christopher Robert Duncan, Chilworthy (GB); Michael Edward Gailes, Hook (GB)

(73) Assignee: Numatic International Limited, Camberley (GB)

( * ) Notice: Subject to any disclaimer, the term of this patent is extended or adjusted under 35 U.S.C. 154(b) by 0 days.

(21) Appl. No.: 09/979,324

(22) PCT Filed: May 2, 2000

(86) PCT No.: PCT/GB00/01688

§ 371 (c)(1),
(2), (4) Date: Jul. 23, 2002

(87) PCT Pub. No.: WO00/69321

PCT Pub. Date: Nov. 23, 2000

(30) Foreign Application Priority Data

| | | |
|---|---|---|
| May 14, 1999 | (GB) | 9911296.3 |
| Jul. 26, 1999 | (GB) | 99117523.4 |
| Mar. 31, 2000 | (GB) | 0007893.1 |

(51) Int. Cl.
*A47L 13/50* (2006.01)
*A47L 13/59* (2006.01)

(52) U.S. Cl. ..... 15/261; 15/264

(58) Field of Classification Search ..... 15/260, 15/261, 264, 262, 263
See application file for complete search history.

(56) References Cited

U.S. PATENT DOCUMENTS

| | | | | |
|---|---|---|---|---|
| 336,956 | A * | 3/1886 | Smith | 100/116 |
| 3,462,788 | A * | 8/1969 | Abbott | 15/119.1 |
| 4,528,717 | A * | 7/1985 | Osberghaus et al. | 15/261 |

FOREIGN PATENT DOCUMENTS

| | | | |
|---|---|---|---|
| DE | 198 27 865 | A1 | 1/2000 |
| DE | 198 27 865 | C2 | 1/2000 |
| EP | 0 127 754 | A1 | 12/1984 |
| EP | 0 127 754 | B1 | 12/1984 |
| EP | 0 824 008 | A2 | 2/1998 |
| EP | 0 824 088 | A3 | 2/1998 |
| EP | 0 906 745 | A1 | 4/1999 |
| EP | 0 910 982 | A2 | 4/1999 |
| EP | 0 910 982 | A3 | 4/1999 |
| GB | 161 854 | A | 5/1921 |
| SE | 470 475 | B | 5/1994 |
| WO | WO 99 51137 | A1 | 10/1999 |

* cited by examiner

*Primary Examiner*—Randall Chin
(74) *Attorney, Agent, or Firm*—Christensen O'Connor Johnson Kindness PLLC

(57) ABSTRACT

A mop press for expressing liquid from a mop head is provided. The mop press includes a housing having reservoir means for receiving the expressed liquid. The reservoir means is provided with drainage means for allowing the extracted liquid to flow from the mop press in a controlled and directed manner. The reservoir means is large enough to accommodate the liquid expressed from the mop such that the mop does not reabsorb the expressed liquid collected therein.

16 Claims, 4 Drawing Sheets

MOP PRESS

This invention relates to the field of mopping and apparatus for so doing, in particular mop presses.

Mop presses of the type used to extract liquid from a mop head are generally well known. Typically a mop press comprises a hopper shaped housing, into which the mop head is placed and a pressing member which is moved across the container, thereby pressing the mop head to express the liquid contained within.

In the field of mopping there are two common types of mops; the flat mop and the kentucky mop. Flat mop heads comprise a flat rectangular absorbent pad mounted on a frame with the narrow ends of the pad being attached to the frame. The frame is lockably hinged in the middle. When in use, the frame is locked in a flat orientation and the pad sits taut against the frame. However, when liquid needs to be expressed from the mop head, the hinge may be unlocked allowing the pad to hang loose from the narrow ends of the frame. The pad may then be placed in a mop press and squeezed. Kentucky mops comprise a bundle of strands of absorbent material hanging from an attachment means at the base of a handle.

Due to the difference in size and shape of flat and kentucky mop heads and different makes of each; at the present time different mop presses are required for each. This is because flat mops are thinner than kentucky mops and so the reduced bulk of a flat mop would mean that the mechanical operating means of a press adapted for a kentucky mop will reach its limit before the mop head is thoroughly squeezed. Mop presses have been developed for use with flat mops wherein the wall against which the mop head is pressed has a foam surface. However, the same problems exist with kentucky mops not being able to be accommodated or flat mops not being effectively pressed.

Furthermore, particularly with kentucky type mops, when the mop head is placed in the housing it does not sit uniformly. Thus, when the pressing member presses the mop head, the pressure is not applied uniformly across the surface of the mop head.

It is a problem with the prior art mop presses that liquid cannot be expressed from different types and sizes of mop heads in a quantity that is sufficient to allow the mop head to be reused without the operating means and pressing member being adjusted for each type of mop head. It is a further problem that the pressing member does not apply pressure uniformly across the surface of the mop head. In view of these problems, there is clearly a need to provide a mop press that addresses these problems.

Furthermore, the liquid expressed from the mop head passes through perforations in the walls and base of the housing and is usually collected in a bucket. Since the liquid leaving the housing through the perforations is being squeezed from the mop, it has a tendency to splash against and over the sides of the bucket. Conventionally this problem has been alleviated by placing the mop press in close proximity to the bucket so that any splashing is lessened. However, this is inconvenient because the mop press must be removed every time the bucket is to be emptied.

In addition, the pressing action of the mop press is typically operated by a hand lever or foot pedal which is mechanically connected to the pressing member in the housing. In order to express sufficient water from a mop head, considerable effort is required. There is a need therefore for a mop press having improved operating and mechanical connection means which permit more effective pressing for the effort exerted.

Hitherto different hand lever configurations for a map wringer have been proposed. In one configuration the lever is mounted on one side wall of the mop housing. This allows unfettered access of the mop to the interior of the housing, but means that if excessive loading is used on the lever the housing tends to tip towards the handle side under the leverage exerted by the user. In another configuration, the lever is pivoted at a point inside the mop press housing so that there is less tendency for excessive force to cause tipping of the housing because asymmetry of the loading is reduced. This mop lever arrangement suffers from the disadvantage that some of the housing volume is taken up or obscured by the lever. It is, therefore, desirable to provide a mop press which has less tendency to tip under loading and where the lever does not obscure the interior of the housing.

According to one aspect of the present invention there is provided a mop press for expressing liquid from a mop head, which mop press includes a pressing mechanism comprising first pressing means, second pressing means and operating means therefor, and resilient packing means, where in use first and second pressing means are brought together and the packing means distorts around the mop head, the arrangement being such that the thickness of the packing means permits pressure to be applied to the mop head whereby a substantial proportion of the liquid contained within the mop head is expressed irrespective of the type and size of the mop head thereby avoiding adjustment of the pressing mechanism.

In a preferred arrangement, the mop press comprises a housing and a pressing plate wherein the first pressing means is the front wall of the housing and the second pressing means is the pressing plate.

Preferably the packing means is associated with the first pressing means. However, the packing means may be associated with the second pressing means or even both the first and second pressing means.

The packing means may be a layer of pliable material which is capable of distortion and/or limited displacement to accommodate different sizes and shapes of mop head. The layer of pliable material may have a cellular structure wherein the material distorts as a result of the collapse of individual cells in the structure when pressure is applied and returning to their original dimensions when the pressure is removed.

Preferably the pliable material is a closed cell foam.

Each time the mop head is placed in the mop press it adopts a different conformation. This is especially true with kentucky mops due to the bundle of strands bunching up in different ways. By providing a layer of pliable material the pressing mechanism may accommodate any protuberances in the mop head by compressing behind, or distorting around, the protuberance. This allows a substantially uniform pressure to be applied across the surface of the mop head each time it is pressed, irrespective of the conformation the mop head adopts.

In a further aspect of the invention, there is provided a mopping layer for use with a foldable flat mop of the type comprising a mop stick and a flat mop head connected one to another by means of an articulated joint, which mop head is formed in foldable portions which permits the mopping layer to depend from the folded portions to enable pressing of the mopping layer, which mopping layer comprises a backing layer provided on an underside thereof with an absorbent working layer and on an upper side thereof with a flexible resilient membrane which flexes to accommodate discontinuities during pressing, thereby permitting a more uniform squeezing of the mopping layer during pressing.

The layer of pliable material or flexible resilient membrane may have a cellular structure wherein the material distorts by a plurality of individual cells collapsing when pressure is applied and returning to their original dimensions when the pressure is removed. Preferably the pliable material is a closed cell foam.

According to another aspect of the present invention there is provided a mop press for expressing liquid from a mop head, which mop press comprises a housing, which housing is provided with a reservoir means for receiving the expressed liquid, which reservoir means is provided with a drainage means wherein the drainage means allows the expressed liquid to flow from the mop press in a controlled and directed manner and wherein the reservoir means is large enough to accommodate the liquid expressed from the mop such that the mop does not reabsorb the expressed liquid collected in the reservoir means on release of the pressing mechanism.

In one embodiment the reservoir means is separated from the region of the housing incorporating the pressing mechanism. The reservoir means may be separated from the region of the housing accommodating said mechanism by a perforated partition. The perforated partition may be a sheer comprising a plurality of holes, alternatively it may be a wire mesh.

The reservoir means may comprise a moulded plastic casing associated with the base of the mop press housing. Preferably the reservoir means is detachable from the mop press.

The drainage means allows the liquid to flow from the mop press in a controlled and directed manner by comprising limited hole means in a limited region of the reservoir means.

Preferably the drainage means comprises a plurality of holes in close proximity. Alternatively, the drainage means may comprise a single hole. The drainage means may comprise a drain pipe. The drainage means may be situated anywhere on the reservoir means but is preferably situated in the centre of a base region of the reservoir means.

In another aspect of the invention, there is provided a mop press for expressing liquid from a mop head, which mop press comprises a hand lever and a foot pedal wherein the hand lever and foot pedal are adapted such that they operate in tandem. Preferably the hand lever and foot pedal are linked by a connecting rod.

Having a hand lever and foot pedal linked so that they operate the mop press in tandem allows the effort required to operate the mop press to be shared between the upper and lower body of the operator thereby reducing exertion. In addition it also allows greater force to be applied if required.

Furthermore, the initial downward pressure on the foot pedal brings the hand lever forward into a more convenient position for an operator to push the lever whilst simultaneously continuing to apply pressure to the pedal.

In another aspect of the invention there is provided a mop press for expressing liquid from a mop head, which mop press comprises a pivotally mounted lever, a pressing member and a toggle joint wherein the lever is linked to the pressing member by the toggle joint, which toggle joint comprises a connecting rod pivotally attached at one end to the lever and at the other end to the pressing member, the arrangement being such that as the pivot between the lever and connecting rod approaches planarity with the pivotally mounted ends of the lever and connecting rod, an increasing mechanical advantage is obtained.

The presence of a toggle joint provides a mechanical advantage firstly due to the difference between the length of the lever and the distance from the pivotally mounted end of the lever to the linkage of the connecting rod with the lever. However, this mechanical advantage increases as the linkage between the lever and connecting rod approaches the plane in which the other ends of the rod lie. The mechanical advantage allows the same force to be applied by the pressing member against the mop head with less effort on behalf of the operator. Alternatively, for the same effort the operator can apply a greater force. Therefore if the operator throws the lever with a constant effort then the increasing mechanical advantage obtained as the linkage approaches a plane, means that the pressing member is applying an increasing pressure on the mop head. This is advantageous as it allows liquid to continue to be squeezed out of the mop head even when the majority has already been removed without any significant extra effort being applied by the user.

The proximity of the linkage to the plane is described as the link angle. The link angle is the angle between the longitudinal axis of the connecting rod and the plane. Preferably the link angle reaches but does not go below one degree.

A toggle joint where the link angle is above one degree retains a force reacting against the joint thereby allowing the lever to easily be returned to its original position. If the link angle goes below one degree then the toggle joint locks and an upwards pressure to the joint is required for it to be released.

In the preferred embodiment, the length of the connecting rod is equal to the distance between the pivotally mounted end of the lever and the pivotal attachment of the connecting rod to the lever.

In a further aspect of the invention, there is provided a janitorial trolley comprising a mop press mounted above a bucket, the arrangement being such that the mop press is mounted a sufficient distance above the bucket to allow the bucket to be emptied without removal of the mop press.

The mop press mounted on the janitorial trolley may have any one, all or none of the features set forth in the different aspects of the invention.

In a preferred embodiment the mop press has a reservoir means and drainage means thereby providing a controlled and directed flow of liquid from the mop press into the bucket without the liquid splashing against and over the sides of the bucket.

The mop press mounted on the janitorial trolley may be operated by a hand lever and a foot pedal, wherein the hand lever and foot pedal are adapted such that the hand lever and foot pedal may operate the mop press in tandem. Preferably the hand lever and foot pedal are linked by a connecting rod.

When mounted on a janitorial trolley where the bucket may be changed without moving the mop press the foot pedal may be attached to the trolley and the hand lever may be attached to the mop press, the hand lever and foot pedal being linked by a solid rod. Preferably the trolley comprises a base member and the foot pedal is mounted thereon.

Following is a description by way of example only and with reference to the accompanying drawings of methods of putting the present invention into effect.

In the drawings

Figure 1:
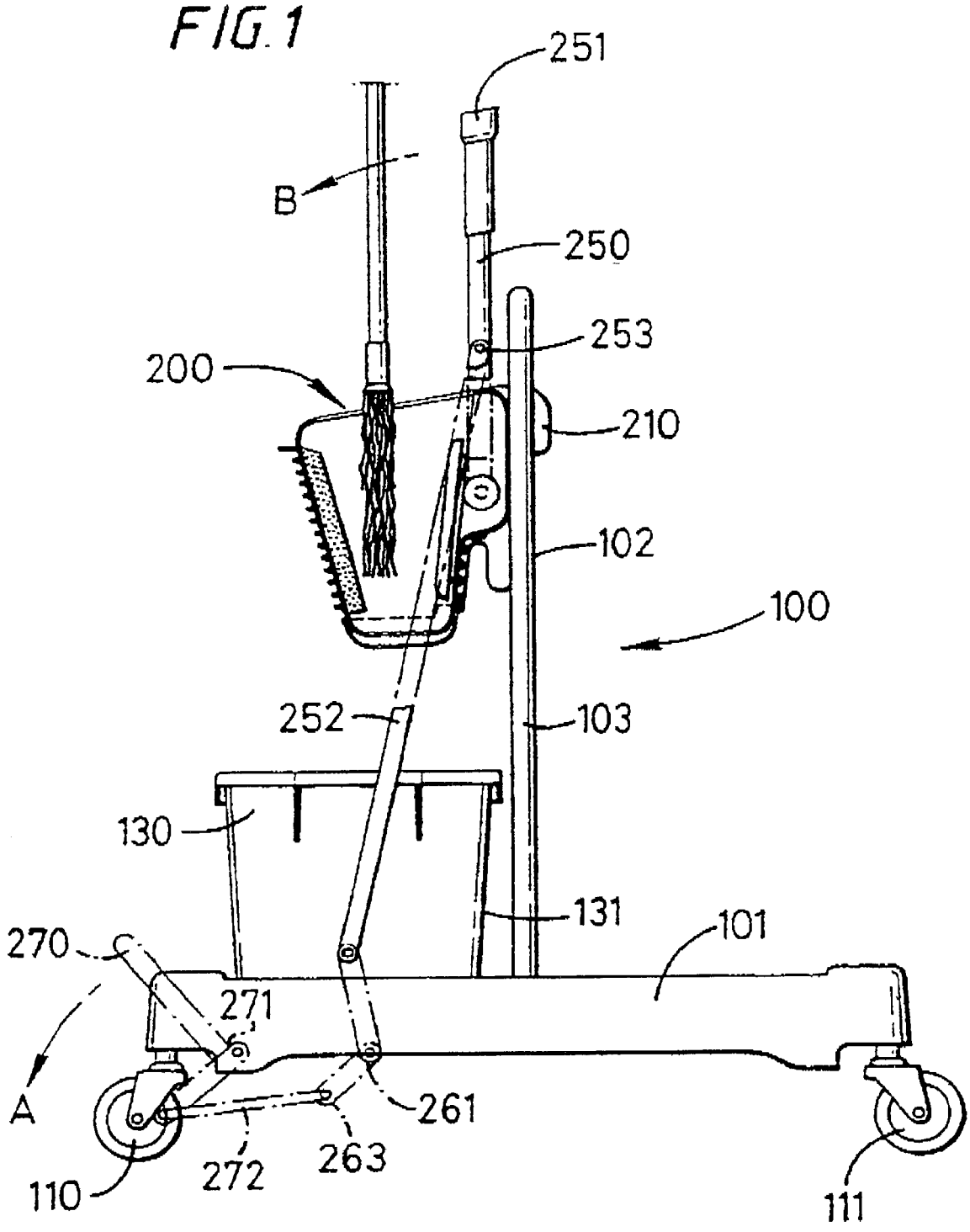
FIG. 1 is a side view, partially in section, of a trolley and mop press according to the present invention.

A janitorial trolley according to the present invention is indicated as 100 in FIG. 1. A rectangular base member 101 is mounted on four castors, one at each corner (only two of which are shown as 110, 111). The front region of the base member 101 is provided with a well (not shown) adapted to accommodate a removable bucket 130. Base member 101 further supports, adjacent a rear wall 131 of the bucket an erect metal frame 102. Frame 102 comprises two upstanding bars (only one visible as 103) laterally spaced apart one from the other by a vertically spaced apart transverse bar (not shown).

Figure 2:
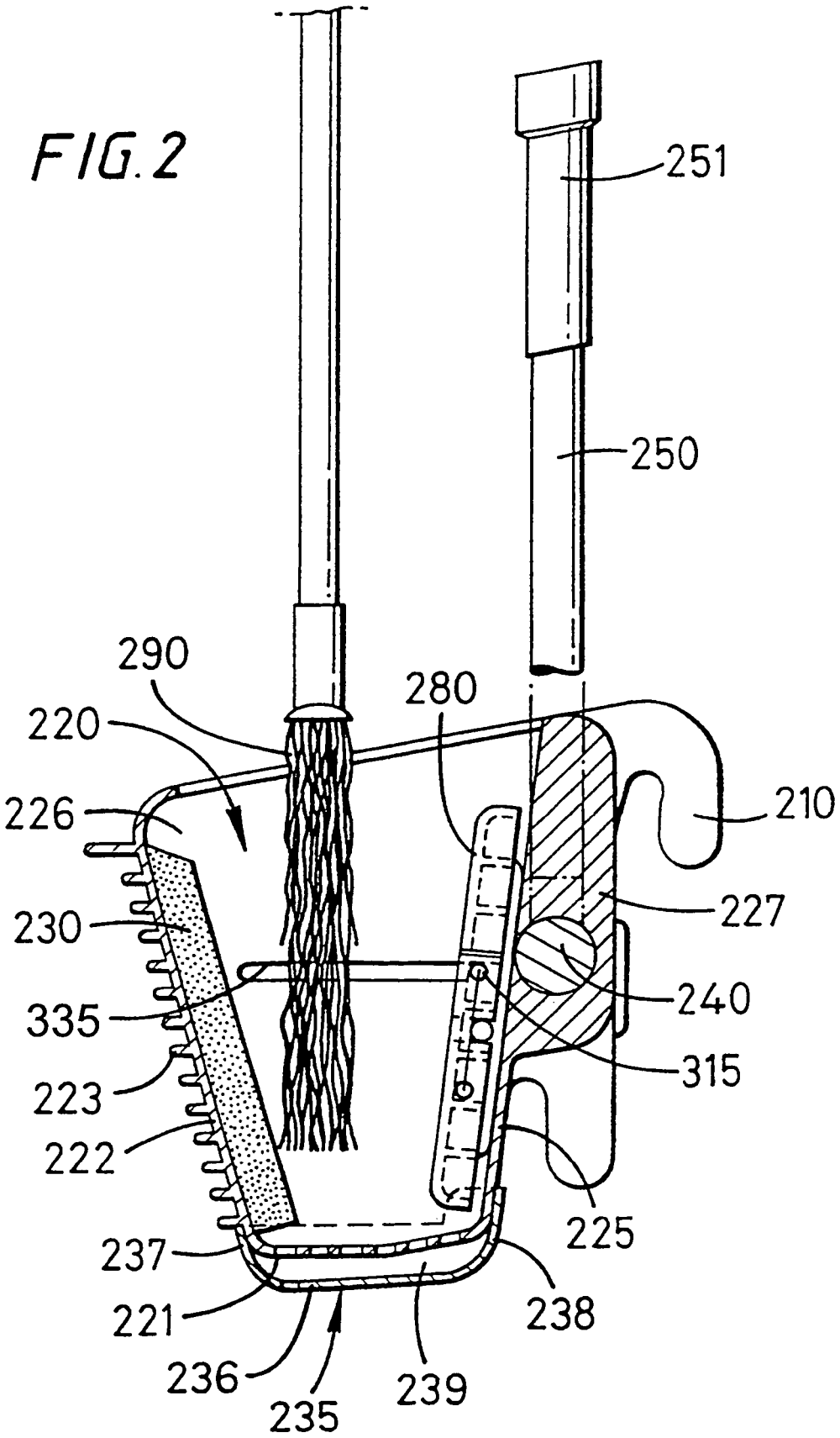
FIG. 2 is a side view, partially in section, of a mop press according to the present invention and as shown in FIG. 1.

The transverse bar of the frame 102 supports a mop press 200 (also indicated in FIG. 2). The mop press 200 comprises two pairs of laterally spaced apart hook members (one visible as 210), each of which is adapted to engage with the transverse bar of the frame. The hook members comprise part of a moulded plastic housing indicated generally at 220. The housing further comprises a base portion 221 provided with a plurality of drain holes. Upstanding and tapering outwards from a front edge of the base portion is a front wall 222. On an outside surface of the front wall there are provided horizontal ridge members 223 which stiffen and strengthen the wall structure. An inside surface of the front wall is provided with a covering of closed cell foam 230. Upstanding and tapering outwardly from a rear edge of the base portion is a rear wall 225.

Base portion 221 of the housing carries a moulded plastic casing indicated generally at 35. The casing has a base portion 236, an upstanding front wall 237, an upstanding rear wall 238 and upstanding side walls (one visible as 239). Base portion 236 of the casing is provided with a plurality of holes (not shown). The holes are limited to a central region of the base portion of the casing.

Figure 3:
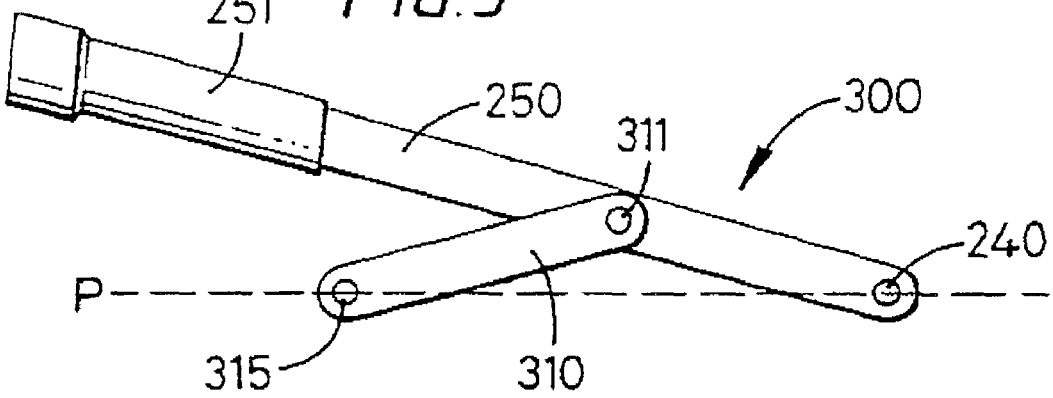
FIG. 3 is a side view of a pressing mechanism used in a mop press according to the present invention and as shown in FIGS. 1 and 2.
Figure 4:
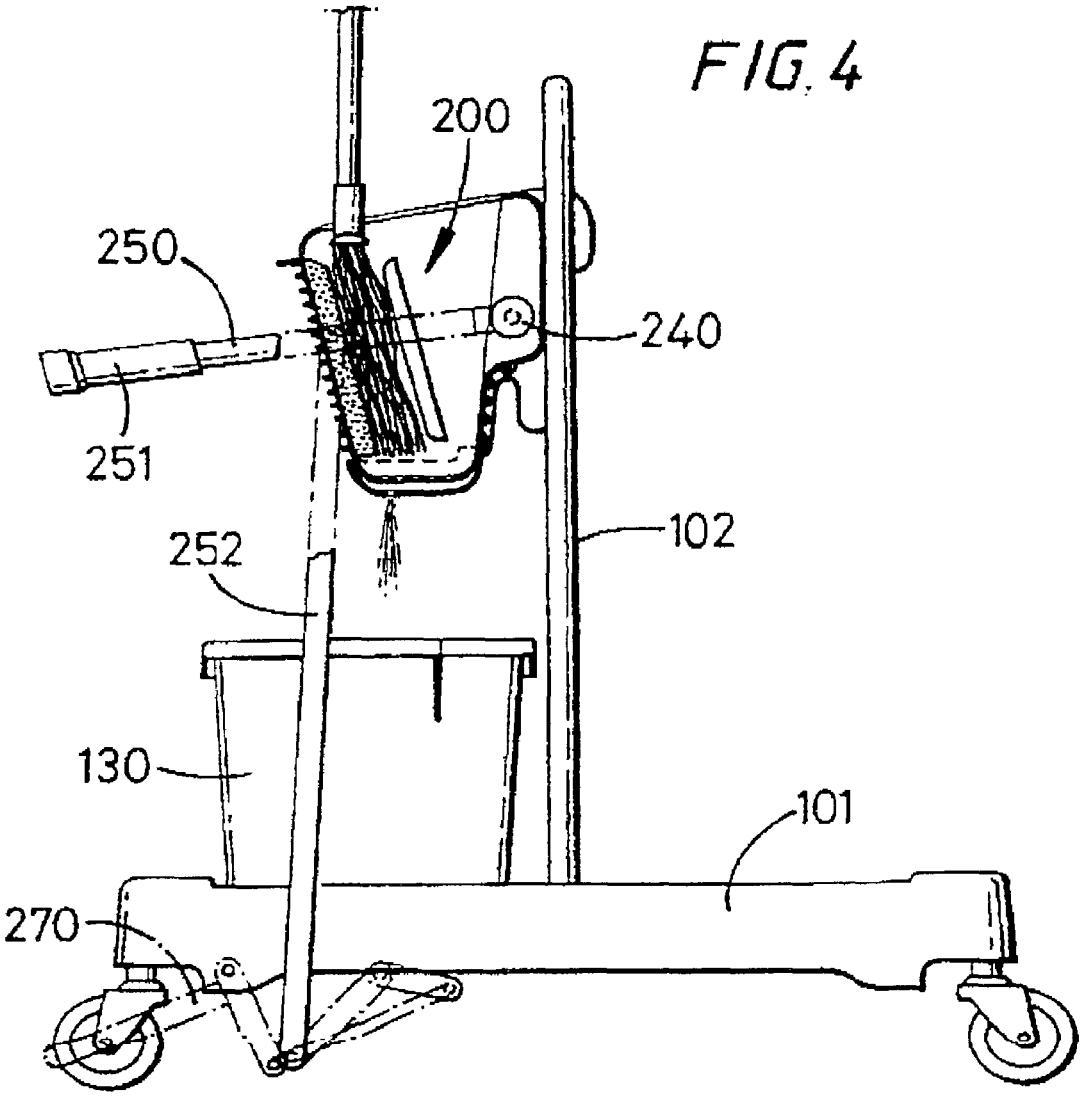
FIG. 4 is the trolley and mop press shown in FIG. 1 whilst in operation.
Figure 5:
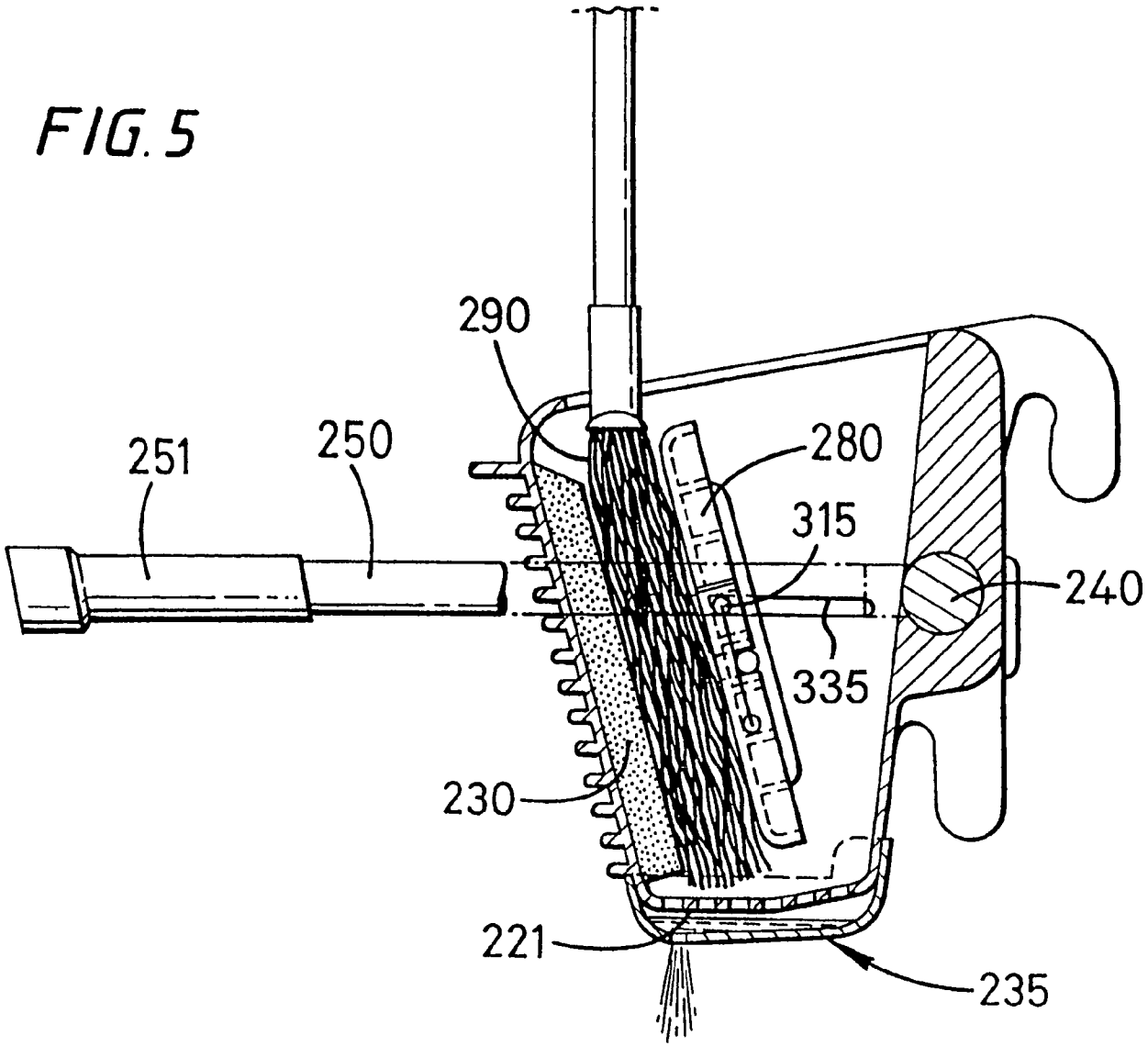
FIG. 5 is the mop press shown in FIG. 2 whilst in operation.

Housing 22 is completed by two upstanding side walls (remote wall visible as 226 near wall partially visible 227). Each side wall is provided with a horizontal slot 335 through which a shaft protrudes. The shaft comprises two end portions and a middle portion. The middle portion of the shaft carries a pressing member 280 located within the housing 220. The near end portion of the shaft forms a pivot 315. Pivot 315 is attached to a connecting rod 310. Connecting rod 310 forms part of a pressing mechanism 300 indicated generally at FIG. 3.

Connecting rod 310 lies adjacent the near side wall of the housing 220 and is attached at a distal end to a lever 250 by a pivot 311. Lever 250 is attached to an axle 240. Axle 240 is mounted next to an outside surface of the rear wall 225 and is located in holes in the side walls. Lever 250 is provided at a distal end thereof with a handle 251. Lever 250 is attached at a point between the handle and the axle to a linking rod 252 by means of a pivot 253. Linking rod 252 extends generally downwards towards the base member 101. Linking rod 252 is pivotally attached to a bell crank 261. Bell crank 261 is located and axially mounted within the base member 101. Bell crank 261 is attached at a distal end 263 to a pedal 270 via a connecting rod 272. Pedal 270 is accommodated within and pivotally attached at a rear end region 271 to the base member 101. The pedal is spring biased about a point of action to permit a return action during use.

The mop press is activated by applying downward foot pressure on the pedal (arrow A), throwing the handle (arrow B) or preferably a combination of both. This causes the lever 250 to rotate about the axle 240 towards a plane P in which axle 240 and pivot 315 lie. The connecting rod 310 rotates about pivot 311 resulting in pivot 315 moving along the horizontal slot 335 away from the axle 240 whilst remaining in the same plane. As a resulting pressing member 280 moves across the housing 220 thereby pressing the mop head 290 against the foam surface 230 situated on the front wall 222. Continued movement of the lever causes pivot 311 to approach plane P whereby an increased mechanical advantage is obtained resulting in the pressing member exerting a greater compressive force on a mop head disposed between the pressing member and foam surface 230.

The foam surface 230 comprises a plurality of individual cells. As the mop head is pressed by the pressing member against the foam surface the cells collapse or deform to accommodate the shape of the mop head whatever conformation it adopts when disposed between the pressing member and the foam surface.

The action of pressing the mop head 290 against the foam surface 230 forces the liquid contained within the mop head out into the housing 220. This liquid passes through the holes in the base portion 221 of the housing into the casing 35. The liquid then passes through the holes in the centre of the base portion 236 of the casing and into the bucket 130. The fewer holes in the casing causes the water to back up within the casing and flow out in a controlled manner into the bucket which can be a couple of feet below.

When the user wishes to remove a mop head which has been squeezed between the pressing member and the front wall pressure is released from the pedal and the spring returns it original position and the handle is returned to its vertical position. This returns the mop press to the ready-for-use configuration with the pressing member resting against the back wall.

It should be noted that the present invention is capable of accommodating and efficiently wringing a wide range of mop head types and sizes because of the pliable nature of the closed cell foam surface on the front wall of the housing. The foam distorts around the mop head and therefore allows even pressure to be applied over the whole of the mop head without the pedal or the lever reaching their operational limit.

The invention claimed is:

1. A mop press for expressing liquid from a mop head, the mop press comprising a housing provided with first pressing means and second pressing means, wherein the first pressing means is a front wall of the housing and the second pressing means is a pressing plate the arrangement being such that in use, with a mop head inserted in the housing, the pressing plate and the front wall may be brought together to press the mop head, wherein the housing is provided with reservoir means for receiving and accumulating expressed liquid, the reservoir means being separated from the region of the housing which accommodates the mop head by first drainage means that allows the expressed liquid to flow from the region of the housing which accommodates the mop head to the reservoir means, the reservoir means being provided with second drainage means which allows the expressed liquid to flow from the reservoir means in a controlled and directed manner, wherein a flow capacity of the first drainage means exceeds a flow capacity of the second drainage means, and wherein the reservoir means is sized to accommodate the expressed liquid from the mop such that the mop does not reabsorb the expressed liquid collected therein.

2. A mop press as claimed in claim 1, wherein the reservoir means is separated from the region of the housing accommodating the mop head by a perforated partition.

3. A mop press as claimed in claim 1, wherein the reservoir means is a molded plastic casing associated with the base of the mop press housing.

4. A mop press as claimed in claim 1, wherein the drainage means includes a drain pipe for directing expressed liquid to a suitable container.

5. A mop press as claimed in claim 1, further comprising operating means for producing relative motion between the first and second pressing means which operating means comprises a hand lever and a foot pedal adapted to operate in tandem.

6. A mop press as claimed in claim 5, wherein initial operation of the foot pedal brings the hand lever into a more favorable orientation for operation which hand lever is then operated in tandem with the foot pedal.

7. A mop press as claimed in claim 5, wherein the hand lever and foot pedal are linked by a connecting rod.

8. A mop press as claimed in claim 5, wherein the operating means further comprises a pivotally mounted lever, a pressing member and a toggle joint, wherein the lever is linked to the pressing member by the toggle joint, which toggle joint comprises a connecting rod pivotally attached at one end to a lever and at the other end to the pressing member the arrangement being such that as the pivot between the lever and connecting rod approaches planarity with the pivotally mounted ends of the lever and connecting rod an increasing mechanical advantage is obtained.

9. A mop press as claimed in claim 8, wherein a length of the connecting rod is equal to a distance between the pivotally mounted end of the lever and the pivotal attachment of the connecting rod to the lever.

10. A mop press for expressing liquid from a mop head, the mop press comprising a housing provided with first pressing means and second pressing means, wherein the first pressing means is a front wall of the housing and the second pressing means is a pressing plate the arrangement being such that in use, with a mop head inserted in the housing, the pressing plate and the front wall may be brought together to press the mop head, wherein the housing is provided with reservoir means for receiving expressed liquid, which reservoir means is separated from the region of the housing which accommodates the mop head, the reservoir means being provided with drainage means which allows the expressed liquid to flow from the mop press in a controlled and directed manner and in that the reservoir means is sized to accommodate the expressed liquid from the mop such that the mop does not reabsorb the expressed liquid collected therein, wherein the mop press is provided with distortion means carried by at least one of said first or second pressing means, the arrangement being such that when the distortion means is in contact with the mop head the distortion means distorts in response to an uneven distribution of the mop head within the press to permit pressure to be applied more uniformly over the surface of the mop head whereby a substantial proportion of the liquid contained within the mop head is expressed irrespective of the type and size of the mop head and in that a thickness of the distortion means is sufficient to accommodate varying sized mop heads without needing to adjust the relative spacing between said first and second pressing means.

11. A mop press as claimed in claim 10, wherein the distortion means is associated with the first pressing means.

12. A mop press as claimed in claim 10, wherein the distortion means is associated with the second pressing means.

13. A mop press as claimed in claim 10, wherein the distortion means is associated with both the first and second pressing means.

14. A mop press as claimed in claim 10, wherein the distortion means is a layer of pliable material carried by the pressing means.

15. A mop press as claimed in claim 10, wherein the distortion means is a closed cell foam.

16. A mop press for expressing liquid from a mop head, said mop press comprises a housing having reservoir means for receiving and accumulating the expressed liquid, the reservoir means being separated from the region of the housing which accommodates the mop head by first drainage means that allows the expressed liquid to flow from the region of the housing which accommodates the mop head to the reservoir means, the reservoir means being provided with second drainage means for allowing the extracted liquid to flow from the mop press in a controlled and directed manner, wherein a flow capacity of the first drainage means exceeds a flow capacity of the second drainage means, wherein the reservoir means is large enough to accommodate the liquid expressed from the mop such that the mop does not reabsorb the expressed liquid collected therein, and wherein the second drainage means is provided in a limited region of the reservoir means.

* * * * *

UNITED STATES PATENT AND TRADEMARK OFFICE

CERTIFICATE OF CORRECTION

PATENT NO. : 7,225,499 B1
APPLICATION NO. : 09/979324
DATED : June 5, 2007
INVENTOR(S) : C.R. Duncan et al.

It is certified that error appears in the above-identified patent and that said Letters Patent is hereby corrected as shown below:

On Title Page

| COLUMN | LINE | ERROR |
|---|---|---|
| Item (30) Pg. 1, col. 1 | Foreign Application Priority Data, line 2 | "99117523.4" should read --9917523.4-- |

Signed and Sealed this

Sixth Day of November, 2007

JON W. DUDAS
*Director of the United States Patent and Trademark Office*